US007218241B2

(12) United States Patent
Kessel et al.

(10) Patent No.: US 7,218,241 B2
(45) Date of Patent: May 15, 2007

(54) DEVICE FOR IDENTIFYING A PERSON OR AN OBJECT

(76) Inventors: David Roy Kessel, 233 Barry Hertzog Avenue, Greenside (ZA) 2913; Lewton Levy, 233 Barry Hertzog Avenue, Greenside (ZA) 2913

( * ) Notice: Subject to any disclaimer, the term of this patent is extended or adjusted under 35 U.S.C. 154(b) by 183 days.

(21) Appl. No.: 10/488,382

(22) PCT Filed: Jul. 25, 2002

(86) PCT No.: PCT/IB02/02903

§ 371 (c)(1),
(2), (4) Date: Oct. 13, 2004

(87) PCT Pub. No.: WO03/019489

PCT Pub. Date: Mar. 6, 2003

(65) Prior Publication Data

US 2005/0046582 A1 Mar. 3, 2005

(30) Foreign Application Priority Data

Aug. 29, 2001 (ZA) ..... 2001/7139

(51) Int. Cl.
*G08B 5/22* (2006.01)
*G09F 9/33* (2006.01)

(52) U.S. Cl. ..... 340/815.45; 340/691.1; 340/573.1; 362/84

(58) Field of Classification Search ..... 340/815.45, 340/573.1, 691.1; 362/83.3, 157, 800, 183; 441/88

See application file for complete search history.

(56) References Cited

U.S. PATENT DOCUMENTS

| | | | | |
|---|---|---|---|---|
| 2,225,151 | A | 12/1940 | Borba | |
| 4,796,167 | A * | 1/1989 | Brown et al. | 362/158 |
| 5,070,437 | A * | 12/1991 | Roberts, Sr. | 362/158 |
| 5,622,422 | A | 4/1997 | Rodgers | |
| 5,633,623 | A | 5/1997 | Campman | |
| 6,086,218 | A * | 7/2000 | Robertson | 362/157 |
| 6,669,352 | B2 * | 12/2003 | McKinney | 362/158 |
| 7,015,654 | B1 * | 3/2006 | Kuhlmann et al. | 315/291 |

* cited by examiner

*Primary Examiner*—Toan N. Pham
(74) *Attorney, Agent, or Firm*—Lahive & Cockfield, LLP

(57) ABSTRACT

The invention provides a device (10) for identifying a person or an object. The device (10) includes a transparent body (42), and embedded within the transparent body (42), a printed circuit board (PCB) (46), a plurality of light emitting diodes (LEDs) (48) electrically connected to the PCB (46), and a diffuser (16). The diffuser (16) is arranged to diffuse light emitted from the LEDs (48) thereby to illuminate the transparent body (42) to form a light source for identifying a person or an object attached to the device (10).

15 Claims, 1 Drawing Sheet

DEVICE FOR IDENTIFYING A PERSON OR AN OBJECT

RELATED APPLICATIONS

This application is a 35 U.S.C. 371 national stage filing of International Application No. PCT/IB02/02903, filed 25 Jul. 2002, which claims priority to South Africa Patent Application No. 2001-7139 filed on 29 Aug. 2001 in South Africa. The contents of the aforementioned applications are hereby incorporated by reference.

BACKGROUND OF THE INVENTION

This invention relates to a device for identifying a person or an object, and more specifically to a device which utilises light to identify a person or an object in dark or dim conditions.

Chemical light sticks for identifying a person in certain circumstances, for example under water, are known. Conventional chemical light sticks generally include a first chemical in an outer, flexible tube and a second chemical sealed within an inner glass tube inside the outer, flexible tube. To activate the light stick the outer tube is bent until the inner tube breaks and releases the first chemical into the second chemical to produce a fluorescent glow. The known types of chemical light sticks are available in different sizes and are marketed under different names, for example GLO-STICK, CYLUME, LIGHT-STICK, CHEM-STICK and CHEM-LIGHT.

A problem associated with known light sticks of the type described above is that the chemicals sustain the fluorescent glow for a limited time only, generally in the region of six hours, and consequently, under normal circumstances, these sticks cannot be re-used. Also, the activation of these light sticks is dependent upon the proper contacting of two chemicals, and consequently these sticks have to be used before an expiry date and often are defective upon purchase.

It is an object of the present invention to provide an alternative light-emitting device for identifying a person or an object which is relatively long-lasting, re-usable and robust.

SUMMARY OF THE INVENTION

According to the invention there is provided a device for identifying a person or an object comprising:

a transparent or translucent body, and embedded within the transparent or translucent body,

- a printed circuit board (PCB),
- a plurality of light emitting diodes (LEDs) electrically connected to the PCB, and
- a diffuser for diffusing light emitted from the LEDs thereby to illuminate the transparent or translucent body to form a light source for identifying a person or an object attached to the device.

In a preferred embodiment of the invention, the diffuser includes a tapered portion defining a surface which is inclined relative to a longitudinal axis of the device at an angle of between 25° and 45°, preferably at an angle of approximately 30°.

In a particularly preferred arrangement, the device includes a housing defining a chamber for at least one battery. In this embodiment, the diffuser may form at least part of the battery housing.

Typically, the PCB is connected to the battery housing and is arranged to hold between three and six LEDs within the transparent or translucent body.

The LEDs and the diffuser preferably are arranged so that, when the transparent or translucent body is illuminated, the light source is visible from all sides of the device.

The device may include attachment means for attaching it to a person or an object.

The device may also include a switch for controlling the flow of current through the LEDs.

The switch may comprise a rotatable member which is threadably engaged with an end cap so as to be displaceable relative to the end cap between an operative position in which it contacts a terminal on a battery within the battery chamber and an inoperative position in which it is spaced from the terminal of the battery.

Alternatively, the switch may be arranged to operate under pneumatic or hydraulic pressure.

Typically, elastomeric O-rings form watertight seals on the end cap and on the rotatable switch member.

The device may also include a second PCB within the battery chamber for connecting a battery contact spring to a wire extending from the first PCB.

Conveniently, the transparent or translucent body is moulded from an epoxy resin, possibly with colour tints, and the PCB defines a plurality of openings for allowing the resin through the PCB during the moulding of the body.

In one arrangement, the battery housing is formed from aluminium, typically a marine grade aluminium, and includes a detachable, aluminium end cap.

In a configuration which produces a preferred strength and quality of light, the transparent or translucent body includes a 19 mm diameter cylindrical section, and six LEDs of 6 mm diameter are embedded within the cylindrical section, adjacent the diffuser, in a circular configuration.

BRIEF DESCRIPTION OF THE DRAWINGS

The invention will now be described in more detail, by way of example only, with reference to the accompanying drawings in which.

DESCRIPTION OF AN EMBODIMENT

Figure 1:
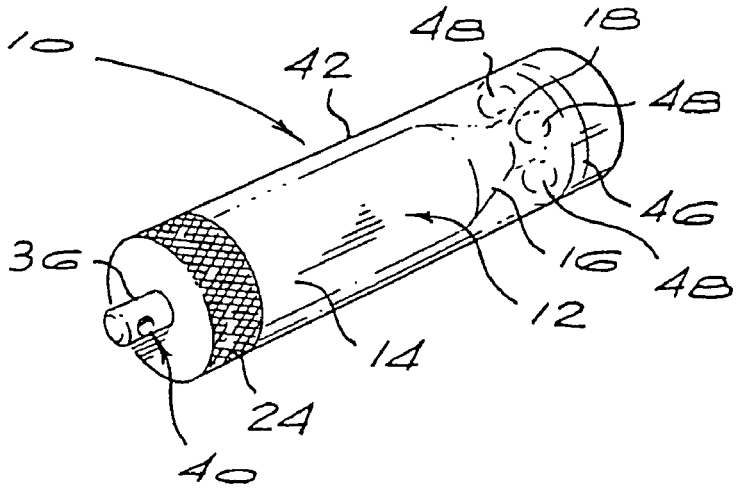
FIG. 1 shows a perspective view of an identifier according to the present invention.

FIG. 1 of the drawings illustrates an identifier 10 according to the present invention. As can be seen, the identifier includes a battery housing 12 which has a cylindrical portion 14, a tapered portion 16 and a connecting stem 18. In this embodiment of the invention, the battery housing is formed from aluminium, typically a marine grade aluminium, and is seen in FIG. 2 to define a chamber 20 for a battery 22 in the form of a single 12V super alkaline cell.

A knurled end cap 24 carrying a thread 26 is engageable with a corresponding thread 28 on the cylindrical portion 14 of the battery housing so as to be detachable for battery replacement. The end cap 24 carries an elastomeric O-ring 30 in an annular groove 32 which forms a watertight seal with the cylindrical portion 14 of the housing 12, in use. A partly threaded bore 34 in the end cap 24 is sized to receive a partly threaded, rotatable switch member 36 which holds an elastomeric O-ring 38 for forming a watertight seal between the rotatable switch member and the end cap. Both O-rings 30 and 38 are silicone-based, high pressure rated O-rings.

Figure 2:
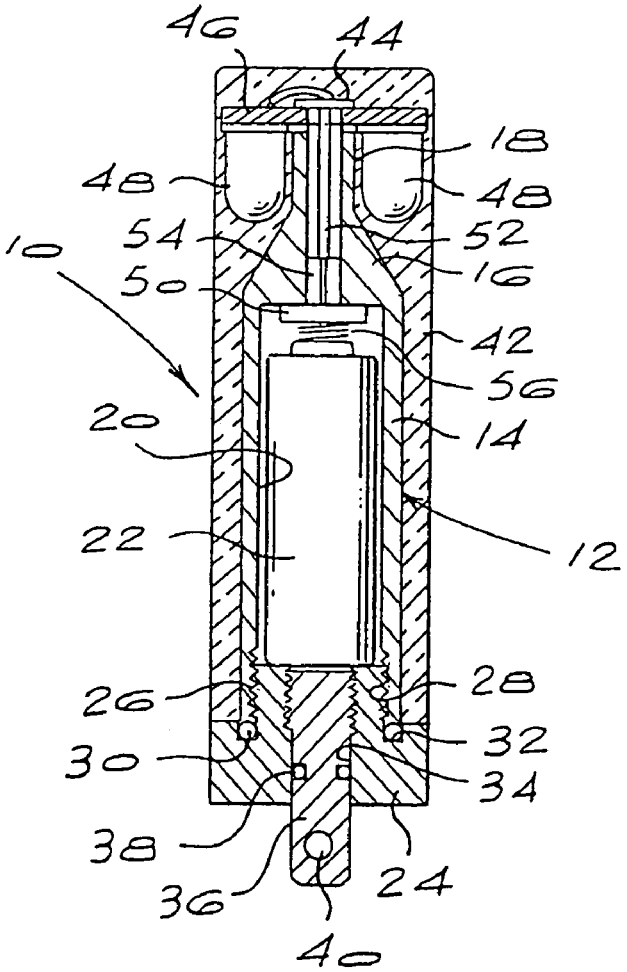
FIG. 2 shows a cross-sectional view of the identifier illustrated in FIG. 1.

In the illustrated embodiment, rotation of the switch member 36 relative to the end cap 24 displaces the member between an inoperative position (as illustrated in FIG. 2) in which it is withdrawn from the battery 22 and an operative position (not illustrated) in which it contacts the negative terminal of the battery. The end cap 24 also includes an aperture 40 for receiving a ring or the like (not shown) for attaching the identifier to a person or an object.

The battery housing 12 is embedded in a transparent body 42 which is formed in a cold moulding process from an epoxy resin, typically NH64FR which is available from Elite Chemical Industries (Pty) Ltd. In this embodiment of the invention, the resin includes a colour tint for facilitating a red glow within the body 42.

A rivet 44 connects a printed circuit board (PCB) 46 to the stem 18 of the battery housing so as to position six high-intensity or ultra high-intensity, red light emitting diodes (LEDs) 48 around the stem, as illustrated. The PCB 46 holds the LEDs 48 in desirable locations within the transparent body 42 and controls the flow of current to these LEDs. An important feature of the PCB 46 is that it includes six openings (not illustrated) along the periphery thereof for allowing the epoxy resin to flow through the PCB in one direction and for air to escape past the PCB in the opposite direction during moulding.

The PCB 46 is electrically connected to a second PCB 50 inside the battery chamber 20 via a wire 52, and a plastics insulator 54 above the PCB 50 allows for charge separation. The PCB 50 provides a link between the wire 52 and a battery contact spring 56 and insulates the positive terminal of the battery 22 from the negatively charged battery housing 12.

In the illustrated embodiment, the tapered portion 16 of the battery housing 12 acts as a diffuser for diffusing light emitted from the LEDs, thereby to illuminate the transparent body 42 to form a light source for identifying a person or object attached to the device.

Figure 3:
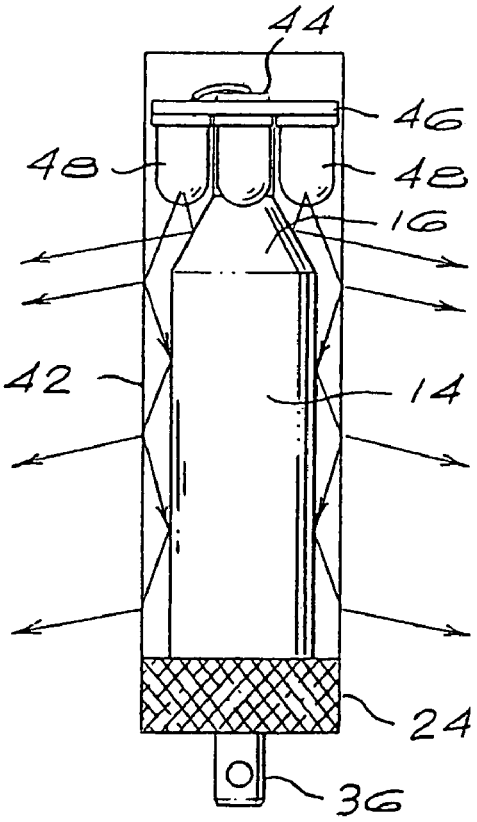
FIG. 3 shows a side view of the identifier according to the invention.

In one application, the identifier 10 may be used to identify a scuba-diver under water. In this application, once the battery 22 has been loaded into the battery chamber 20 and the end cap 24 has been securely connected to the battery chamber, the switch member 36 is rotated into contact with the battery so as to close a circuit between the positive and negative terminals of the battery. With the circuit closed, current flows through the end cap 24, the battery housing 12, the rivet 44, the PCB 46 and the LEDs 48, and then back to the battery 22 via the wire 52, the PCB 50 and the contact spring 56. As light is emitted from the LEDs into the transparent body 42, the light is diffused by the diffuser 16, and is deflected, reflected and refracted in the manner illustrated in FIG. 3 to produce a red glow within the body 42. It should be appreciated that the glow in the body 42 is visible from all sides of the identifier 10. The identifier is then connected to the diver's clothing or equipment by means of a connecting ring extending through the aperture 40 in the switch member 36 to identify the diver under water.

It will be appreciated that although the identifier has been described above with reference to a rotatable switch, the switch could be arranged to operate under pneumatic or hydraulic pressure. For example, the identifier may be connectable to a high/low pressure stage in a scuba system so that the switch activates upon the opening of the cylinder valve and is deactivated when the cylinder valve is sealed and depressurised.

It will also be appreciated that although the invention has been described above with reference to red LEDs, various other coloured LEDs, for example amber, blue or green, could be used. Furthermore, the LEDs could be arranged to emit white light or, for military applications, infra-red light, if desired. In other, non-illustrated embodiments of the invention, the LEDs are arranged to emit dual tones and/or to flash on and off.

Furthermore, it will be appreciated that apart from scuba-diving applications, the identifier 10 could be used in many other applications, for example as an identifier for people or objects in mining applications, military applications, emergency services applications, or recreational applications including fishing, cycling or mountain climbing after sunset or before sunrise.

In another, non-illustrated embodiment of the invention, the identifier 10 includes a rechargeable battery unit instead of the battery 22.

A major advantage of the identifier according to the embodiment of the invention described above is that it is long-lasting and hence can be re-used a number of times. It is anticipated that the battery life will be at least 48 hours, and the detachable end cap 24 allows for the replacement of batteries, as required. Also, with the PCB 46 and the LEDs 48 embedded within the transparent body 42, the identifier 10 is fairly robust. A further advantage of the identifier 10 is that it is relatively small and light, and consequently is easy to use.

The invention claimed is:

1. A device for identifyng a person or an object comprising:

a transparent or translucent body, and embedded within the transparent or translucent body, a battery housing which defines a chamber for at least one battery, the battery housing including a connecting stem, a printed circuit board (PCB) connected to the connecting stem of the battery housing, a plurality of light emitting diodes (LEDs) electrically connected to the PCB, the LEDs positioned around the connecting stem of the battery housing, a diffuser formed by at least a portion of the battery housing for diffusing light emitted from the LEDs to illuminate the transparent or translucent body; and an end cap which is detachably engageable with the battery housing to provide access to the battery chamber for battery replacement.

2. A device according to claim 1, wherein the diffuser includes a tapered portion defining a surface which is inclined relative to a longitudinal axis of the device at an angle of between 25° and 45°.

3. A device according to claim 2, wherein the surface is inclined relative to the longitudinal axis of the device at an angle of 30°.

4. A device according to claim 1, wherein the PCB is arranged to hold between three and six LEDs within the transparent or translucent body.

5. A device according to claim 1, wherein the LEDs and the diffuser are arranged so that, when the transparent or translucent body is illuminated, the light source is visible from all sides of the device.

6. A device according to claim 1, further comprising attachment means for attaching the device to a person or an object.

7. A device according to claim 1, further comprising a switch for controlling the flow of current through the LEDs.

8. A device according to claim 7, wherein the switch comprises a rotatable member which is threadably engaged with an end cap so as to be displaceable relative to the end cap between an operative position in which it contacts a terminal on a battery and an inoperative position in which it is spaced from the terminal of the battery.

9. A device according to claim 8, further comprising elastomeric O-rings forming watertight seals on the end cap and on the rotatable switch member.

10. A device according to claim 7, wherein the switch is arranged to operate under pneumatic or hydraulic pressure.

11. A device according to claim 1, further comprising a second PCB within the chamber for connecting a battery contact spring to a wire extending from the first PCB.

12. A device according to claim 1, wherein the transparent or translucent body is molded from an epoxy resin, and the PCB defines a plurality of openings for allowing the resin through the PCB during the molding of the body.

13. A device according to claim 12, wherein the epoxy resin includes color tints.

14. A device according to claim 1, wherein the housing and the end cap are formed from aluminum.

15. A device according to claim 1, wherein the transparent or translucent body includes a 19 mm diameter cylindrical section, and six LEDs of 6 mm diameter are embedded within the cylindrical section, adjacent the diffuser, in a circular configuration.

* * * * *